US005695100A

United States Patent [19]

O'Brien

[11] Patent Number: 5,695,100

[45] Date of Patent: Dec. 9, 1997

[54] BABY BACKPACK SUN/RAIN SHADE DEVICE

[76] Inventor: Vincent E. O'Brien, 241 Via Barranca, Greenbrae, Calif. 94904

[21] Appl. No.: 695,710

[22] Filed: Jul. 19, 1996

[51] Int. Cl.[6] ..... A47C 7/66; E04H 15/02

[52] U.S. Cl. ..... 224/160; 224/186; 135/96; 135/143; 135/151; 135/153; 297/184.13; 297/184.17

[58] Field of Search ..... 244/158, 159, 244/160, 161, 186, 189, 190, 409, 627, 628, 629, 633, 634, 645; 135/88.02, 90, 96, 143, 147, 151, 152, 153, 154, 156; 297/184.11, 184.13, 184.15, 184.17

[56] References Cited

U.S. PATENT DOCUMENTS

| | | |
|---|---|---|
| 4,112,957 | 9/1978 | Biven . |
| 4,286,739 | 9/1981 | Silcott et al. . |
| 4,293,162 | 10/1981 | Pap et al. . |
| 4,809,724 | 3/1989 | Fuser . |
| 4,883,315 | 11/1989 | Ferguson . |
| 4,915,120 | 4/1990 | Ziolkowski . |
| 5,007,674 | 4/1991 | Franc . |
| 5,205,308 | 4/1993 | Kendall et al. . |
| 5,320,405 | 6/1994 | Foster et al. . |
| 5,363,871 | 11/1994 | Garrand et al. . |

*Primary Examiner*—David J. Walczak

*Assistant Examiner*—Charles R. Eloshway

*Attorney, Agent, or Firm*—Flehr, Hohbach, Test, Albritton & Herbert

[57] ABSTRACT

A sunshade device for use with a baby backpack formed for supporting a baby occupant therein includes a first mounting bracket coupled to a first flame portion of the baby backpack, and a second mounting bracket coupled to the second frame portion of the baby backpack. A U-shaped rear shade support includes a rear bight portion extending upwardly from the backpack having one end coupled to the first mounting bracket and an opposite end is coupled to the second mounting bracket. The baby backpack shade device further includes a U-shaped front shade support having a front bight portion extending upwardly from the backpack, and having a first end and an opposite second end pivotally coupled to the first mounting bracket and the second mounting bracket, respectively. The front shade support is movable between a closed position, nested with the rear shade support, and a opened position, extending forwardly of the rear shade support. A flexible, sheet-like sunshade is also included having a rear end mounted to the rear bight portion of the rear shade support and an opposite front end mounted to the from bight portion of the front shade support. In the opened position, the sheet-like sunshade is oriented to extend vertically over the occupant for shielding thereof, while in the closed position, the sunshade can be selectively closed rearwardly of the occupant to enable easy ingress and egress from the backpack.

28 Claims, 6 Drawing Sheets

BABY BACKPACK SUN/RAIN SHADE DEVICE

TECHNICAL FIELD

The present invention relates, generally, to sun shade devices, and, more particularly, relates to sun/rain shades mountable to baby backpacks.

BACKGROUND ART

Recently, baby backpacks have experienced a substantial growth in popularity as a desirable alternative to strollers or physically holding the baby. These backpacks enable a convenient and comfortable means of carrying or supporting a child during extended excursions such as nature hikes or the like.

Typically, a lightweight foldable tubular frame is provided which is mountable and supportable on the backpacker's back, shoulders and waist. These frames usually include an upper horizontal cross-bar and opposing, spaced-apart side frame portions extending generally vertically downward from the cross-bar and on opposite sides of the baby occupant. A flexible sheet-like support is generally suspended or mounted to the frame member which is formed to secure and support the child therein.

While these baby backpacks adequately provide reasonable comfortable for the child and backpacker during outdoor hikes, the child's upper extremities are left completely exposed to the sun, rain and other environmental elements. Such overexposure to the sun may cause a substantial sunburn on the child's delicate skin and features. Not only is this extremely discomforting, but repeated burning may increase susceptibility to future skin problems. Moreover, overexposure to the sun can cause heat prostration as well; while extended exposure to the rain can cause numerous sicknesses.

DISCLOSURE OF INVENTION

Accordingly, it is an object of the present invention to provide a baby backpack device which protects the child from the sun and rain.

It is another object of the present invention to provide a baby backpack sunshade device which can be retrofitted to most baby backpacks.

Another object of the present invention is to provide a baby backpack sunshade device which is lightweight.

Still another object of the present invention is to provide a baby backpack sunshade device which is easily detachable from the backpack frame.

Yet another object of the present invention is to provide a baby backpack sunshade device which can be moved between a closed and a opened condition.

It is still another object of the present invention to provide a baby backpack sunshade device which easily enables ingress and egress from the baby chair.

Another object of the present invention to provide a baby backpack sunshade device which can easily be folded against the backpack frame for storage purposes.

It is a further object of the present invention to provide a baby backpack sunshade device which is durable, compact, easy to maintain, has a minimum number of components, and is easy to use by relatively unskilled personnel.

In accordance with the foregoing objects, the present invention provides a sunshade device for use with a baby backpack formed for supporting a baby occupant therein, and including a first frame portion and an opposing second frame portion. The sunshade device includes a first mounting bracket coupled to the first frame portion, and a second mounting bracket coupled to the second frame portion. A U-shaped rear shade support includes a rear bight portion extending upwardly from the backpack. One end of the rear shade support is coupled to the first mounting bracket and an opposite end is coupled to the second mounting bracket. The baby backpack shade device of the present invention further includes a U-shaped front shade support having a front bight portion extending upwardly from the backpack, and having a first end and an opposite second end pivotally coupled to the first mounting bracket and the second mounting bracket, respectively. In accordance with the present invention, the front shade support is movable between a closed position, nested with the rear shade support, and a opened position, extending forwardly of the rear shade support. A flexible, sheet-like sunshade is also included having a rear end mounted to the rear bight portion of the rear shade support and an opposite front end mounted to the front bight portion of the front shade support. Hence, in the opened position, the sheet-like sunshade is oriented to extend vertically over the occupant for shielding thereof. Further, in the closed position, the sunshade is selectively closed rearwardly of the occupant to enable easy ingress and egress from the backpack.

The first mounting bracket and the second mounting bracket each preferably includes a mounting wall defining a V-shaped mounting groove formed and dimension to receive the first frame portion and the second frame portion, respectively, therein. Moreover, each bracket includes a securing device for removably mounting the respective frame portion in the mounting groove of the mounting bracket.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
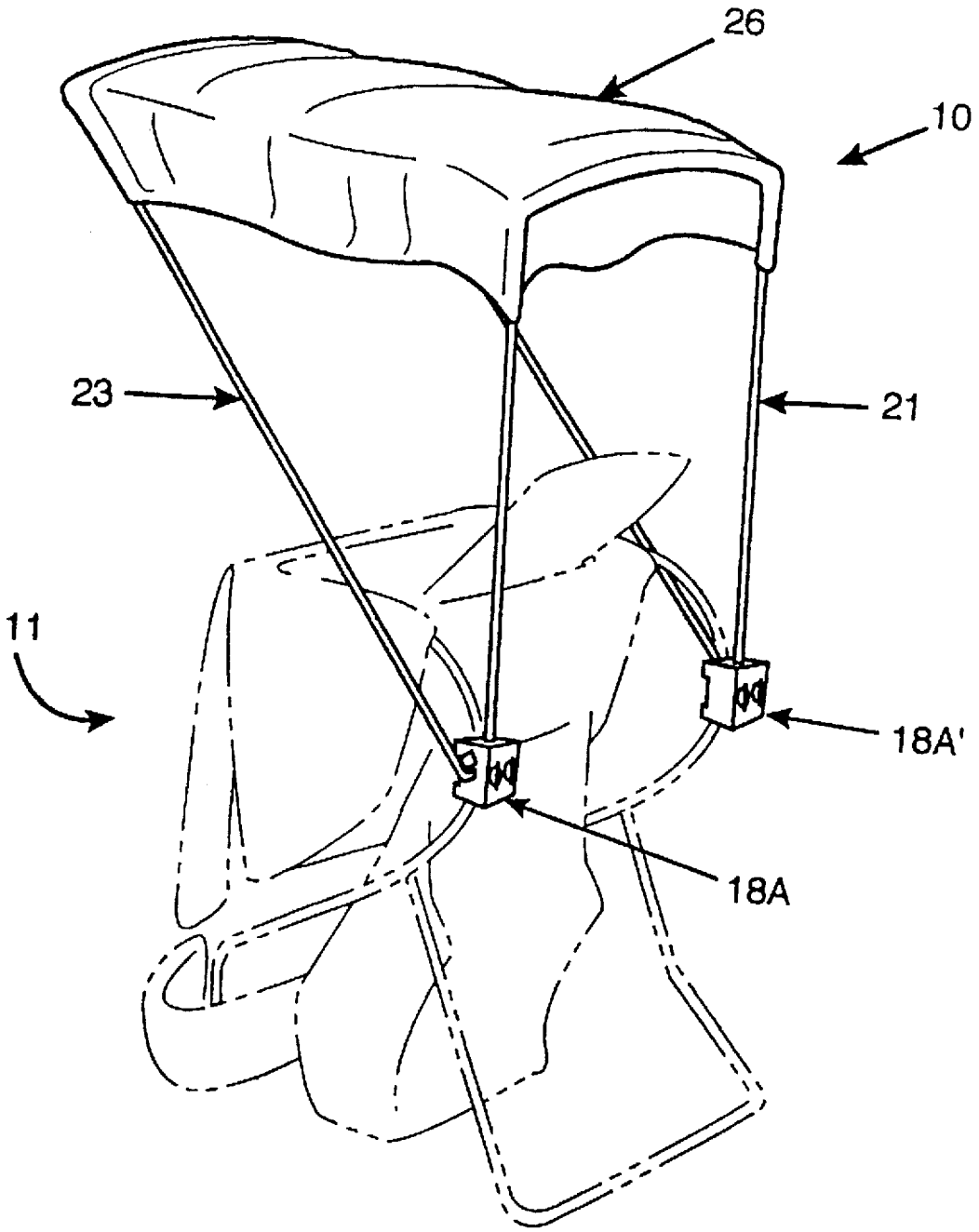
FIG. 1 is a top perspective view of a baby backpack sunshade device constructed in accordance with the present invention, shown mounted to a baby backpack apparatus.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 3:
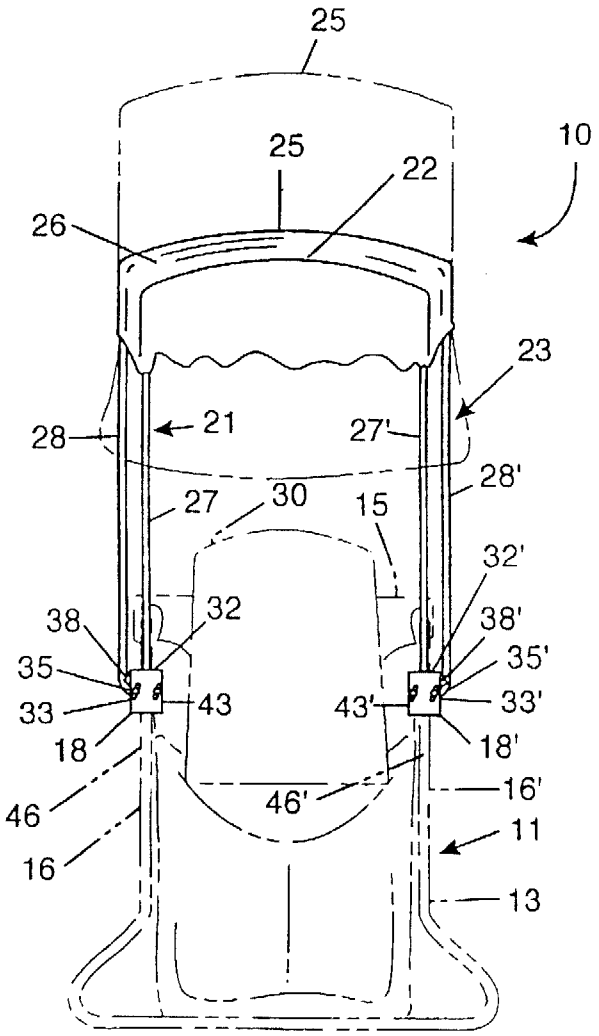
FIG. 3 is a rear elevation view of the baby backpack sunshade device of FIG. 1.
Figure 2:
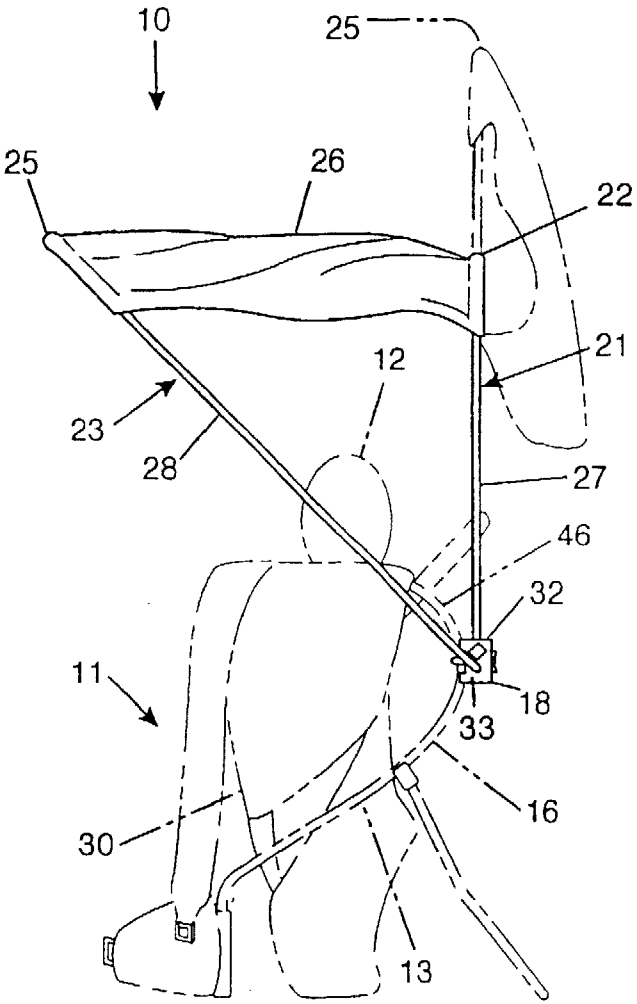
FIG. 2 is a side elevation view of the baby backpack sunshade device of FIG. 1, illustrating movement thereof between a opened position (shown in solid lines) and a closed position (shown in broken lines).

Attention is now directed to FIGS. 1–3, where the present invention provides a sunshade device, generally designated 10, for use with a baby backpack 11 formed for supporting a baby occupant 12 therein. Briefly, the baby backpack includes a backpack frame 13 having a crossbar 15 rigidly securing a first frame portion 16 and an opposing second frame portion 16'. The sunshade device 10 of the present invention includes a first mounting bracket 18 coupled to first frame portion 16, and a second mounting bracket 18' coupled to second frame portion 16'. For ease of description, only one mounting bracket 18 (FIG. 5) will be referred to since the opposite mounting bracket 18' (and its associated structure) is a mirror image of mounting bracket 18. A U-shaped rear shade support, generally designated 21, includes a rear bight portion 22 extending upwardly from backpack 11. One end of rear shade support 21 is coupled to first mounting bracket 18 while an opposite end thereof is coupled to second mounting bracket 18'. The baby backpack shade device 10 of the present invention further includes a U-shaped front shade support, generally designated 23, having a front bight portion 25 extending upwardly from backpack 11, and having a one end and an opposite end pivotally coupled to the first mounting bracket 18 and the second mounting bracket 18', respectively.

In accordance with the present invention, front shade support 23 is movable between a closed position (phantom lines in FIG. 2), nested with rear shade support 21, and a opened position (solid lines in FIG. 2), extending forwardly of rear shade support 21. A flexible, sheet-like sunshade 26 is also included having a rear end mounted to rear bight portion 22 of the rear shade support 21 and an opposite front end mounted to front bight portion 25 of front shade support 23. In the opened position, the sheet-like sunshade 26 is oriented to extend vertically over the occupant 12 for shielding thereof. Further, in the closed position, sunshade 26 is closed rearwardly of the occupant 12 to enable easy ingress and egress from backpack 11.

Accordingly, a sunshade device is provided for baby backpacks for protective shading to the baby occupant from the sun or rain. This sunshade device is formed and dimensioned to be retrofit to a plurality of baby backpacks, such as the GERRY® backpack, the TOUGH TRAVELER® backpack, the KELTY® backpack and any other baby backpack with an exposed rear frame. The present invention sunshade device is capable of articulation between a closed position, facilitating ingress and egress from the baby seat, and a opened position, providing protective cover vertically over the child's head and shoulders from the damaging rays of the sun.

As best shown in FIGS. 2 and 3, each rear and front shade support is generally U-shaped having bight portions 22, 25 and two downwardly depending leg portions 27, 27' and 28, 28', respectively. It will be appreciated that the term U-shaped includes any shade support having a cross-bar and two downwardly depending leg portions therefrom. Hence, the bight portion could be arcuate, smoothly integrating with the leg portions, or substantially straight, intersecting the leg portions perpendicularly or at generally right angles.

Rear shade support 21 is preferably mounted to the spaced-apart bracket members 18, 18', to be described in greater detail below, in a manner positioning the rear bight portion 22 rearwardly of the baby occupant 12. Accordingly, when the front shade support 23 is positioned in the closed position (phantom lines in FIG. 2), nested with the rear shade support 21, the sheet-like sunshade 26 is preferably positioned behind the seated baby. This provides ample room for ingress and egress to and from the baby seat support 30 which is suspended or mounted to the backpack frame 13. Further, such rearward positioning of the rear shade support 21 relative the backpack frame 13 assures that the sheet-like sunshade 26 extends sufficiently rearwardly of the seated baby occupant 12 to provide ample shading or sun shielding rearwardly thereof.

As viewed in the solid lines of FIG. 2, the front shade support 23 is formed and dimensioned to articulate the front bight portion 25 thereof to an orientation forward of the seated baby occupant 12 when the front shade support is in the opened position. Similar to the rearward positioning of the rear shade support 21, the forward positioning of the front bight portion 25 relative the backpack frame 13 assures that the sheet-like sunshade 26 extends sufficiently forward of the seated baby occupant to provide ample coverage or sun shielding forwardly thereof. Accordingly, in the opened position, the rear shade support 21, the front shade support 23 and the sheet-like sunshade 26 cooperate to provide substantial sun shielding during outdoor use.

In the preferred embodiment, the leg portions 27, 27' of rear shade support 21 are releasably and slidably mounted in respective mounting bore 31, 31' formed in the top surfaces 32, 32' of the first and second mounting brackets 18, 18'. Hence, the rear shade support can be easily removed from the mounting brackets to facilitate storage or transportability. Further, it will be understood that while the leg portions 27, 27' of rear shade support 21 are oriented substantially vertical and parallel one another, the leg portions may be angled relative one another and relative the mounting brackets without departing from the true spirit and nature of the present invention.

Figure 5:
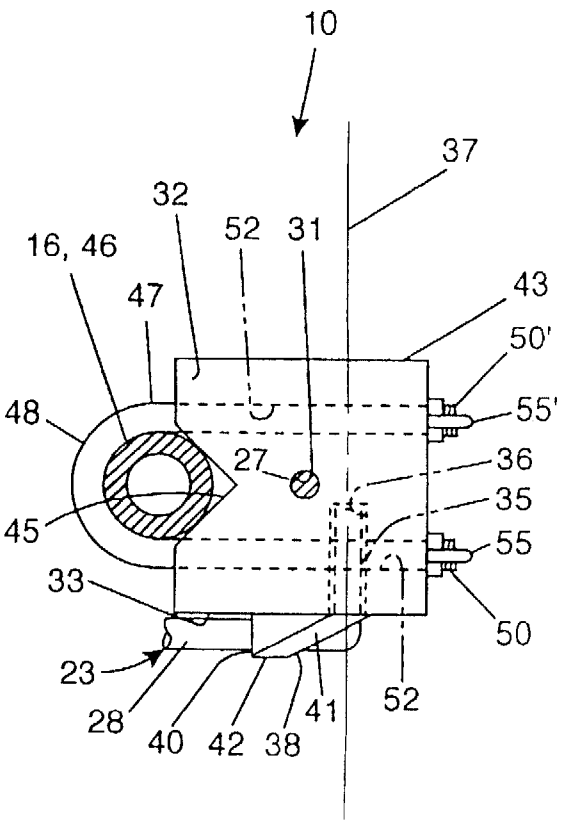
FIG. 5 is a fragmentary, top plan view of the mounting bracket of FIG. 4.

Regarding the front shade support 23, to facilitate articular motion between the closed position and the opened position, the distal ends of the leg portions 28, 28' are pivotally coupled to the respective mounting brackets 18, 18'. Again, for ease of description, only mounting bracket 18 (FIG. 5) will be referred to since mounting bracket 18' (and its associated structure) is a mirror image of mounting bracket 18. FIG. 5 illustrates that each leg portion 28, 28' of the front shade support includes a finger portion 35, 35' angled inwardly toward the respective outer side wall 33, 33' for pivotal engagement therewith. Accordingly, in the closed position, the leg portions 28, 28' of the front shade support 23 are nested outside and adjacent the respective leg portions 27, 27' of the rear shade support (FIG. 3), so as not to interfere with one another during the pivotal movement. Each outer side wall of mounting bracket 18, 18' includes finger passageways 36, 36' formed and dimensioned for sliding and rotational receipt of the respective finger portions 35, 35' therein.

Figure 4:
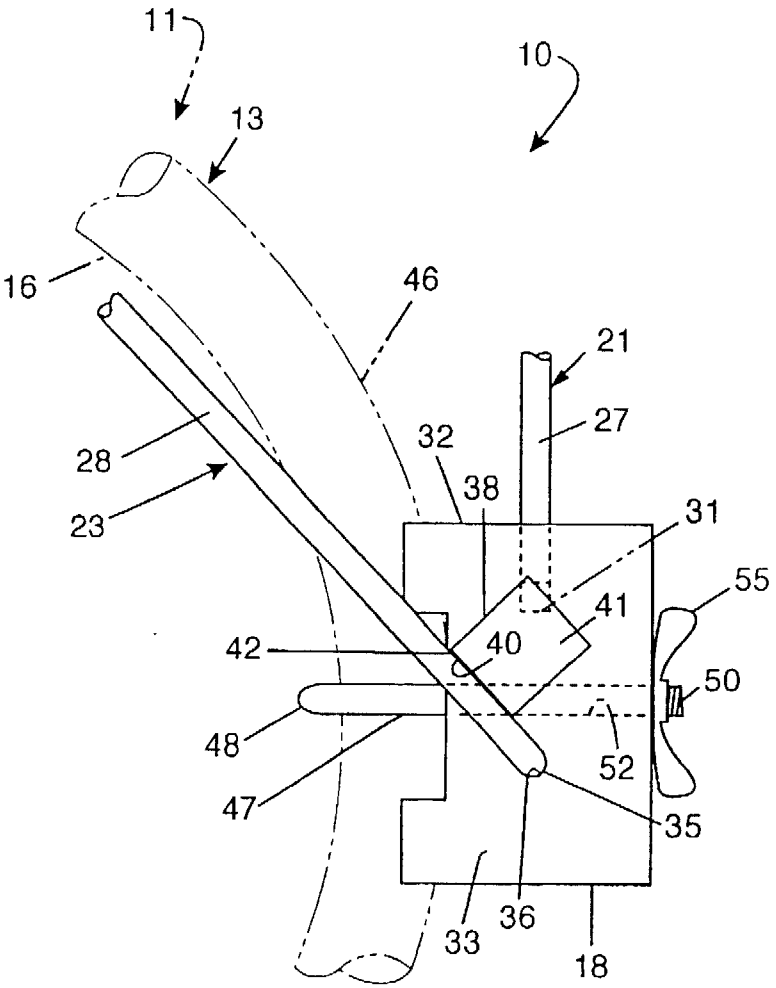
FIG. 4 is an enlarged, fragmentary, side elevation view of a mounting bracket of the baby backpack sunshade device of FIG. 1.

As best viewed in FIG. 4, each finger portion 35, 35' is capable of rotational movement therein about a rotational axis 37 extending longitudinally through each finger portion.

This arrangement enables pivotal movement of the front shade support between the closed and opened position. In the preferred form, when the front shade support is moved to the closed position, the outer leg portions thereof are situated in substantially the same plane extending through the leg portions 27, 27' of the rear shade support 21.

A wedge-shaped stop member 38, 38' extends outwardly from each outer side wall 33, 33' which is formed to retain the leg portions 28, 28' in the opened position. Each stop member includes shoulder portion 40 formed to engage the respective leg portion to prevent inadvertent collapse of movement to the closed position which is extremely desirable during windy conditions.

FIG. 5 illustrates that the backside of each stop member 38, 38' includes a gradually sloped face 41 formed to enable easy deployment to the opened position from the closed position. Accordingly, when the front shade support 23 is moved from the closed position to the opened position, the leg portions 28, 28' of the front shade support 23 slidably contact the sloped face 41 until the leg portions move just past the intersecting edge 42 between shoulder portion 40 and the sloped face 41. Once past, the respective finger portions 35, 35', which have moved outwardly of the respective finger passageway 36, 36' in a direction away from the respective outer side wall 33, 33', move inwardly toward the respective outer side wall and into the finger passageway to lock in the opened position and into contact against the shoulder portions thereof.

Movement back to the closed position is easily accomplished by pulling the finger portions out of the respective finger passageway until the respective leg portions clear the shoulder portion. Subsequently, the front shade support 23 can be articulated back into a nested position with the rear shade support 21.

While the preferred embodiment is illustrated with the leg portions of the front shade support arranged on the outside of the leg portions of the rear shade support, it will be appreciated that the leg portions 28, 28' of the front shade support could be pivotally coupled to the respective inner side walls 43, 43' of the respective mounting brackets without departing from the true nature and spirit of the present invention.

Turning now to FIGS. 4 and 5, each mounting bracket 18, 18' is formed and dimensioned for releasable mounting to the tubular first and second frame portions 16, 16' of the backpack frame 13. Again, for the ease of description, however, only one mounting bracket 18 will be described in detail since the opposing mounting bracket 18' is merely the mirror image thereof. Mounting bracket 18 includes a mounting groove 45 shaped to receive a portion of the respective frame portion 16 therein. Preferably, the mounting groove 45 is V-shaped to accommodate frame portions 16, 16' of varying shapes and diameters. Moreover, as shown in FIG. 4, mounting groove 45 is formed to secure against both straight frame portions or curved frame portions. This is advantageous for retrofitting since many baby backpack frames 13 include U-shaped curved portions 46, 46' (shown in phantom) which extend rearwardly of the cross-bar 15.

To secure the respective frame portion in the V-shaped groove 45 a securing device 47 in the form of a U-shaped bolt 47 is provided to releasably mount the respective mounting bracket to the first and second frame portions, respectively. As best viewed in FIG. 5, each U-shaped bolt includes a bolt bight portion 48 formed and dimensioned to extend around the tubular frame portion for secured engagement therewith. The leg portions 50, 50' of bolt 47 are formed for sliding receipt through longitudinal holes 52, 52' extending through the mounting bracket 18 from the front side to the back side. Wing nuts 55, 55' or the like urge the bight portion into contact with the frame portion 16 which in turn urge the frame portion 16 into contact with the V-shaped groove 45.

It will be understood that a variety of other type securing devices may be provided which are generally known to those skilled in the art without departing from the true nature and spirit of the present invention. These may include, although are not limited to, hook-shaped bolts, pivotal jaws or other clamping devices.

Figure 6:
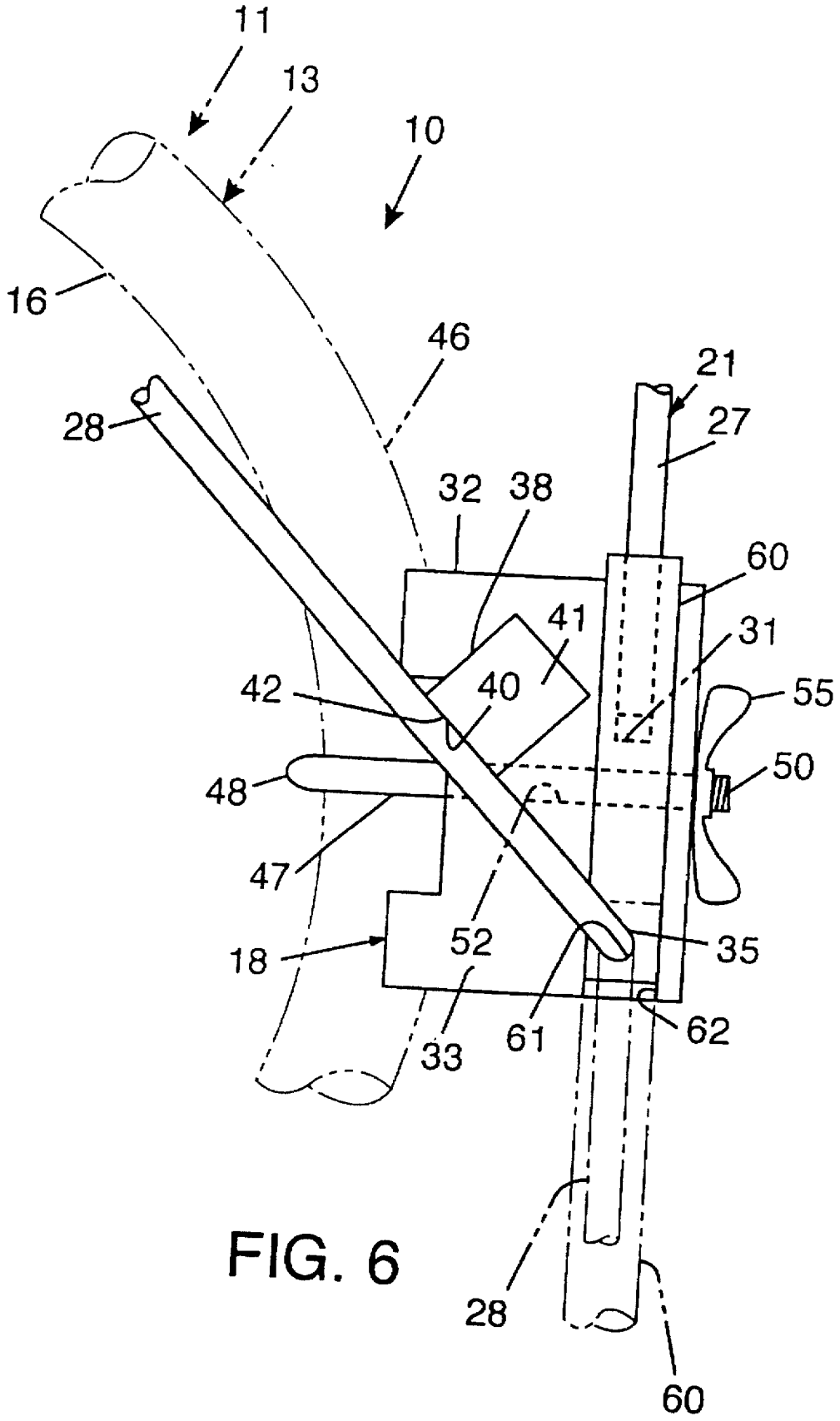
FIG. 6 is an enlarged, fragmentary, side elevation view of an alternative embodiment of a mounting bracket for the baby backpack sunshade device of FIG. 1.
Figure 8:
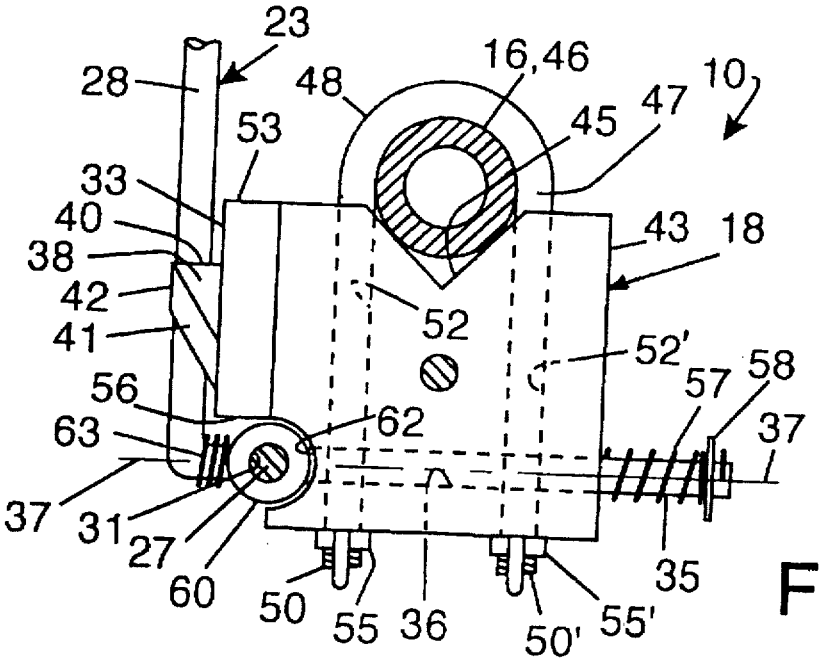
FIG. 8 is a fragmentary, top plan view of the mounting bracket of FIG. 6.
Figure 7:
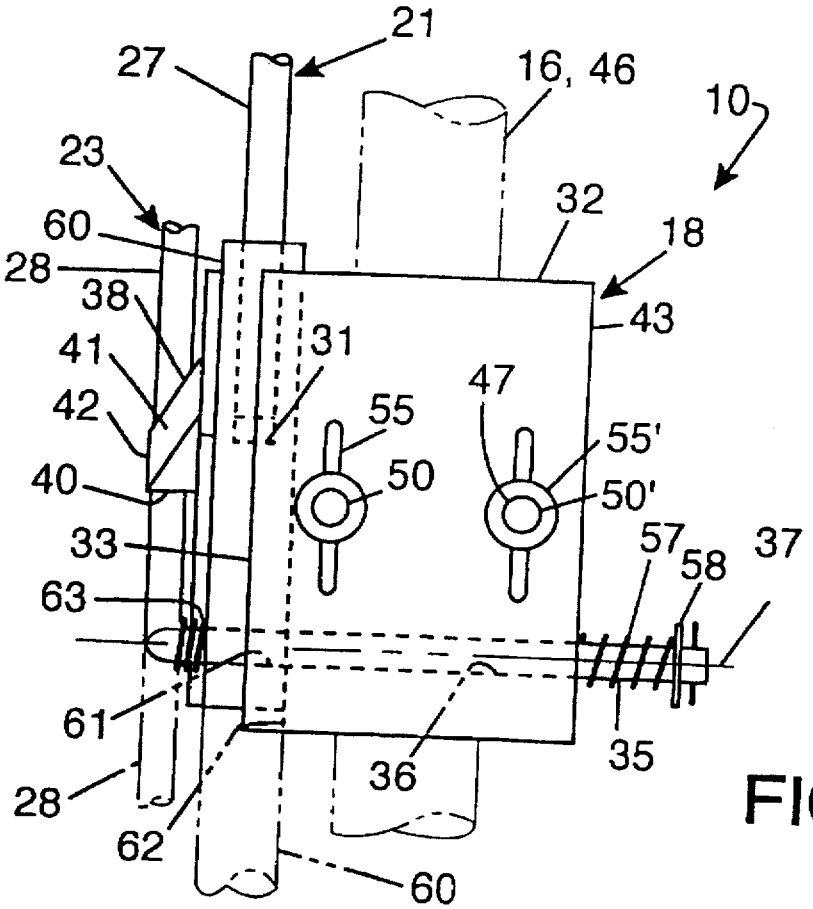
FIG. 7 is a fragmentary rear elevation view of the mounting bracket of FIG. 6.

Turning now to FIGS. 6–8, an alternative embodiment to the present invention will be described in which the leg portions 28, 28' of front shade support 23 are biased in a direction inwardly in a manner urging the respective finger portions 35, 35' into the finger passageways 36, 36'. Again, for the ease of description, only one mounting bracket 18 will be described in detail since the opposing mounting bracket 18' is merely the mirror image thereof. As shown, a first spring member 57 is included urging leg portion 28 inwardly toward respective mounting bracket 18. This is particularly advantageous to retain front shade support 23 in the opened position and in contact with shoulder portion 40 of stop member 38.

In the preferred embodiment, as best viewed in FIG. 7, finger portion 35 is formed and dimensioned to fit through finger passageway 36 such that a distal end thereof extends beyond inner side wall 43. First spring member first 57 is preferably provided by a compression spring which is compressed between inner side wall 43 and a washer member 58 or the like mounted proximate the distal end of finger portion 35. Accordingly, the outward axial force caused by first compression spring 57 urges finger portion 35 to extend further into finger passageway 36 until the leg portion 28 of front shade support 23 nearly abuts against the base member 60 proximate the outer side wall 33. This assures that the leg portion will be locked behind and against the shoulder portion 40 of stop member 38 when oriented in the opened position.

In yet another alternative embodiment of the present invention, after front shade support 23 has been moved to the closed position (solid lines in FIGS. 6 and 7), nested with rear shade support 21, both shade supports may be pivoted rearwardly as a unit to a further stowed position (phantom lines in FIGS. 6 and 7), positioning the shade supports 21, 23 and sheet-like sunshade 26 out of the way for ease of storage. Hence, disassembly of the front and rear shade supports from the respective mounting brackets for storage purposes will be precluded in many instances.

As shown in FIGS. 6 and 8, a pivotal base member 60, preferably tubular, is provided pivotally coupled to the outer side wall 33 of mounting bracket 18. A top surface of base member 60 defines mounting bore 31 therein which is formed to receive the distal end to the leg portion 27 of rear shade support 21. To enable the base member 60 and the rear shade leg portion 27 to pivot as a unit, the finger portion 35 of the front shade leg portion 28 extends through a hole 61 proximate a lower end of base member 60. Hence, finger portion 35 extends through both base member 60 and mounting bracket 18 so that the shade supports pivot relative one another and relative to the bracket member between the closed position and the stowed position.

To facilitate maintenance of the base member in either the closed position or the stowed position, outer side wall 33 provides a retaining slot 62 (FIG. 8) extending substantially vertically therealong. Retaining slot 62 is preferably semi-cylindrical shaped and of a diameter similar to that of tubular base member 60. Accordingly, when base member 60 is generally aligned with retaining slot 62 in preferably a substantially vertical closed position or the stowed position, the base member is received in the retaining slot for support therein.

To articulate the front and rear shade supports between the closed and stowed position, base member 60 must be removed from retaining slot 62 in a direction outwardly along axis 37. This is accomplished by moving both the leg portions of respective front and rear shade supports outwardly along axis 37 until base member 60 is removed from retaining slot 62 by a distance sufficient to clear stop member 38. Base member 60 can then be pivoted about axis 37.

Once pivotally moved to the desired orientation (i.e., the closed position or the stowed position), the compressed first spring member 57 will urge finger portion 35 back into finger passageway 36, and base member 60 back into retaining slot 62. FIG. 8 further illustrates the addition of a second spring member 63 provided between leg portion 28 and base member 60 to further urge the base member into retaining slot 62. Second spring member 63 further enables movement of leg portion 28 of the front shade support without disturbing the positioning of base member 60 and the rear shade support. It will be appreciated, however, that the compressive force of the first spring member 57 is greater than the compressive force of second spring member 63.

To further prevent base member 60 from pivoting forwardly toward the skewed leg portions 28, 28' of front shade support 23 in the opened position, a forward stop portion 53 of outer side wall 33 protrudes further outward (FIG. 8) deepening the retaining slot 62 in the forward direction. Hence, inadvertent forward pivotal movement of base member 60 is substantially more difficult as the base member will contact a retaining wall 56 of forward stop portion 53.

In an effort to provide further protection to the child occupant during operation, the sheet-like sunshade 26 could include a mosquito netting or the like (not shown) which drapes around and the perimeter of the sheet-like shade. This arrangement will assure ample circulation while providing additional protection against insects. Moreover, the sheet-like sunshade could include front, side and/or rear curtains or shielding to further extend down the sides of the front and rear shade supports for added protection from the sun.

Figure 9B:
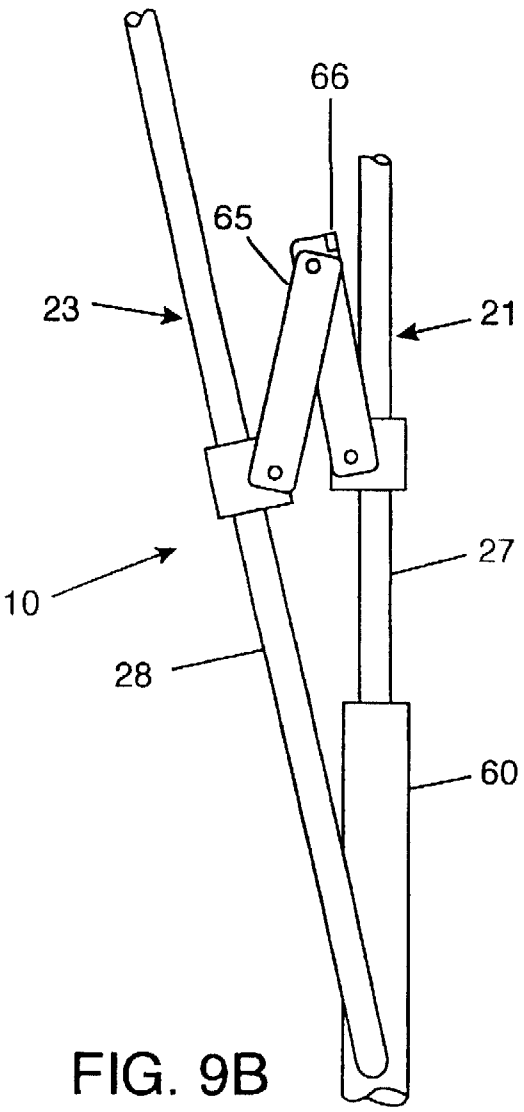
FIGS. 9A and 9B are side elevation views of an alternative embodiment of the backpack sunshade device incorporating a scissor-type joint between the shade supports.
Figure 9A:
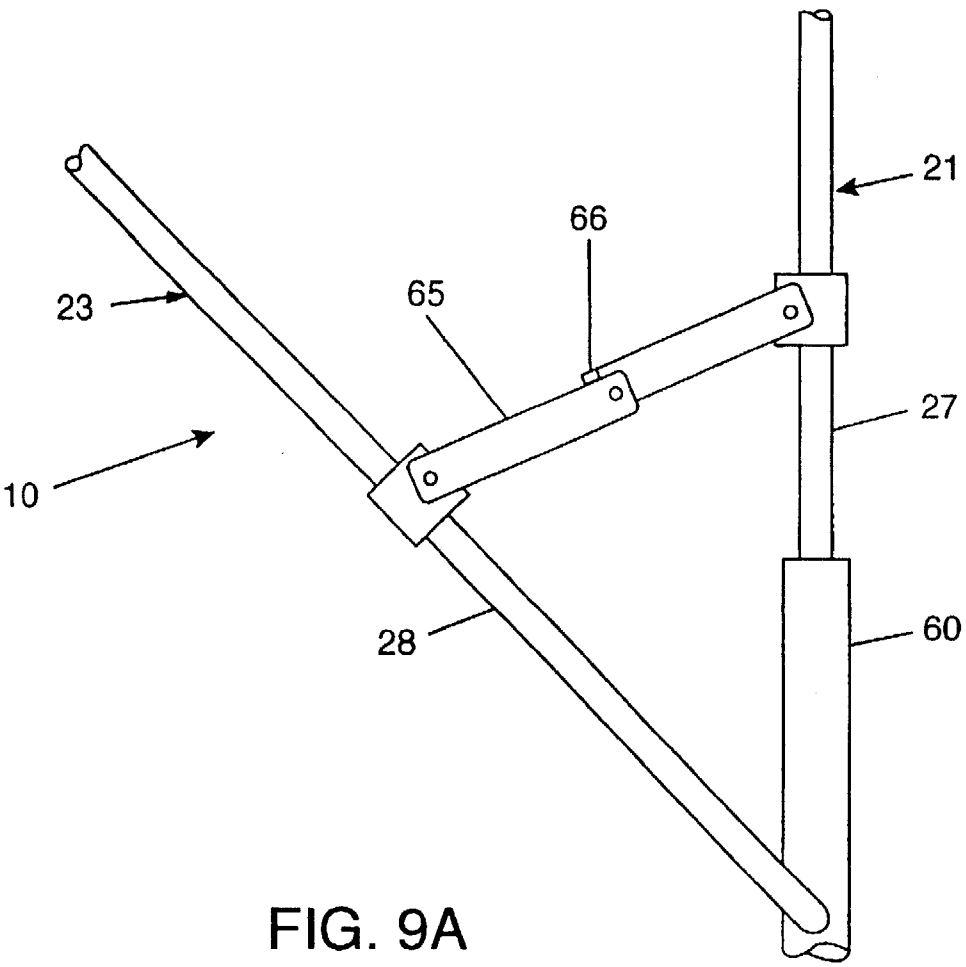

In yet another alternative embodiment, as shown in FIGS. 9A and 9B, scissor-type foldable joints 65 may be included mounted to and between the leg portions 28 of the front shade support 23 and the leg portions 27 of the rear shade support 21. When the front shade support 23 is moved to the opened position, the scissor-type joint 65 is formed and dimensioned to be fully extended (FIG. 9A). In contrast, when the front shade support 23 is moved to the closed position, the scissor-type joint 65 would be folded together (FIG. 9B).

In the opened position, the scissor-type joint is slightly over extended until a nub member 66 of one of the arms engages an edge of other arm. Such over extension facilitates prevention of inadvertent closure, especially during windy conditions.

What is claimed is:

1. A sunshade device for use with a baby backpack formed for supporting an occupant therein, and having a first substantially vertically oriented frame portion and an opposing second substantially vertically oriented frame portion, said sunshade device comprising:

a first mounting bracket adapted to be coupled to the first frame portion;

a second mounting bracket adapted to be coupled to the second frame portion;

a U-shaped rear shade support having a rear bight portion adapted for extending upwardly from the backpack, and having one end coupled to the first mounting bracket and an opposite end coupled to the second mounting bracket, said rear shade support including a pair of leg portions extending downwardly from opposite sides of the rear bight portion and each terminating at the one end and the opposite end, respectively, such that said rear shade support is oriented substantially vertically;

a U-shaped front shade support having a front bight portion adapted for extending upwardly from the backpack, and having a first end and an opposite second end pivotally coupled to the first mounting bracket and the second mounting bracket, respectively, between a closed position, nested with the rear shade support, and a opened position, extending forwardly of said rear shade support, said from shade support including a pair of leg portions extending downwardly from opposite sides of the front bight portion and each terminating at the first end and the opposite second end, respectively, such that the leg portions of the front shade support are skewed and acutely angled relative to the leg portions of the rear shade support when oriented in the opened position; and a flexible, sheet-like sunshade having a rear end mounted to the rear bight portion of the rear shade support and an opposite front end mounted to the front bight portion of the front shade support in a manner extending over the occupant for shielding thereof in the opened position, and closed rearwardly of the occupant in the closed position the length of said sheet-like sunshade and the length of the front shade support leg portions cooperating to orient said sheet-like sunshade substantially horizontally when oriented in the opened position.

2. The sunshade device according to claim 1 wherein, the rear shade support and the front shade support are relatively rigid.

3. The sunshade device according to claim 2 wherein, the leg portions of the rear shade support are mounted to and extend upwardly from a top portion of each respective mounting bracket.

4. The sunshade device according to claim 1 wherein, the leg portions of said front shade support are oriented in substantially the same plane extending through the leg portions of said rear shade support when oriented in the nested position.

5. The sunshade device according to claim 1 wherein, the leg portions of said front shade support are formed and dimensioned to be positioned outside the leg portions of said rear shade support when oriented in the nested position.

6. The sunshade device according to claim 5 wherein, the first end and opposite second end of the leg portions of said front shade support are formed and dimensioned to pivotally mount to outer side walls of the first mounting bracket and second mounting bracket, respectively.

7. The sunshade device according to claim 6 wherein, the first mounting bracket and the second mounting bracket each includes a mounting wall defining a mounting groove formed and dimensioned to receive the first frame portion and the second frame portion, respectively, therein.

8. The sunshade device according to claim 7 wherein, each mounting groove is V-shaped.

9. The sunshade device according to claim 7 wherein, the first mounting bracket and the second mounting bracket each includes a securing device for removably mounting the respective mounting bracket to the respective frame portion.

10. The sunshade device according to claim 9 wherein, each frame portion is tubular-shaped, and each securing device is formed and dimensioned to secure the respective frame portion in and against the respective mounting groove.

11. The sunshade device according to claim 10 wherein, each securing device includes a curved portion formed to securably grip the respective frame portion when secured thereto.

12. The sunshade device according to claim 10 wherein, each securing device is provided by a U-shaped bolt member having elongated ends extending through respective passageways extending through the respective mounting brackets, and locking members releasably locking the respective elongated ends to the respective mounting bracket.

13. The sunshade device according to claim 6 further including:

a biasing device coupled between each leg portion of the front shade support and the respective mounting bracket to bias the leg portions inwardly toward the respective mounting bracket.

14. The sunshade device according to claim 13 wherein, each leg portion of the front shade support includes inwardly directed finger portions formed for pivotal receipt in finger passageways defined by respective outer side walls of the first and second mounting brackets.

15. The sunshade device according to claim 14 wherein, said biasing device is provided by compression spring members each cooperating with a respective finger portion.

16. The sunshade device according to claim 1 wherein, the first mounting bracket and the second mounting bracket each includes a mounting wall defining a mounting groove formed and dimensioned to receive the first frame portion and the second frame portion, respectively, therein.

17. The sunshade device according to claim 16 wherein, each mounting groove is V-shaped.

18. The sunshade device according to claim 16 wherein, the first mounting bracket and the second mounting bracket each includes a securing device for removably mounting the respective mounting bracket to the respective frame portion.

19. The sunshade device according to claim 18 wherein, each frame portion is tubular-shaped, and each securing device is formed and dimensioned to secure the respective frame portion in and against the respective mounting groove.

20. The sunshade device according to claim 19 wherein, each securing device is provided by a U-shaped bolt member having elongated ends extending through respective passageways extending through the respective mounting brackets, and locking members releasably locking the respective elongated ends to the respective mounting bracket.

21. The sunshade device according to claim 1 further including:

a stop member retaining the front shade support in the opened position.

22. The sunshade device according to claim 21 wherein, said stop member is mounted to said first mounting bracket in an orientation engaging the leg portion of the front shade support when moved to the opened position.

23. The sunshade device according to claim 1 wherein, the one end and the opposite end of the leg portions of the rear shade support are further pivotally coupled the respective first and second mounting brackets to enable further movement of said front shade support and said rear shade support from the closed position to a stowed position, positioning the front bight portion and the rear bight portion below the occupant.

24. The sunshade device according to claim 23 wherein, at least one of the first mounting bracket and the second mounting bracket includes a base member pivotally coupled thereto, and defining a mounting bore formed and dimensioned for sliding receipt of at least one of the one end and the opposite end of the corresponding leg portions of the rear shade support to enable pivotal movement between the closed position and the stowed position.

25. The sunshade device according to claim 24 wherein, a respective outer side wall of the at least one of the first mounting bracket and the second mounting bracket defines a retaining slot formed and dimensioned for retaining receipt of the base member in one of the closed position and the stowed position.

26. The sunshade device according to claim 25 wherein, said base member is cylindrical-shaped and said retaining slot is semi-cylindrical shaped of a diameter similar to that of said base member.

27. The sunshade device according to claim 25 wherein, each leg portion of the front shade support includes inwardly directed finger portions formed for pivotal receipt in finger passageways defined by the respective outer side walls of the first and second mounting brackets, and said base member including a finger hole formed for the respective finger portion therethrough for pivotal movement between the closed position and the stowed position.

28. The sunshade device according to claim 27 further including:

a biasing device coupled between at least one of the leg portions of the front shade support and the respective mounting bracket to bias the at least one leg portion inwardly toward the respective mounting bracket; and a spring device biasing the base member in the retaining slot.

* * * * *

UNITED STATES PATENT AND TRADEMARK OFFICE

CERTIFICATE OF CORRECTION

PATENT NO. : 5,695,100
DATED : December 9, 1997
INVENTOR(S) : O'Brien

It is certified that error appears in the above-identified patent and that said Letters Patent is hereby corrected as shown below:

Column 8, claim 1,
Line 25, change "from" to -- front --.

Signed and Sealed this

Twenty-ninth Day of January, 2002

*Attest:*

*Attesting Officer*

JAMES E. ROGAN
*Director of the United States Patent and Trademark Office*